US006604805B2

(12) United States Patent
Nguyen et al.

(10) Patent No.: US 6,604,805 B2
(45) Date of Patent: Aug. 12, 2003

(54) PRINTING SYSTEM AND METHOD USING PAGE STITCHING FOR PRINTING ON ROLL MEDIA

(75) Inventors: Trung Vu Nguyen, Portland, OR (US); Stephen A Smith, Ridgefield, WA (US); Dean C Bayerle, Poway, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1 day.

(21) Appl. No.: 09/970,165

(22) Filed: Oct. 2, 2001

(65) Prior Publication Data

US 2003/0063140 A1 Apr. 3, 2003

(51) Int. Cl.[7] ..... B41J 29/38
(52) U.S. Cl. ..... 347/14; 347/12
(58) Field of Search ..... 347/12, 43, 154, 347/171, 41, 19, 37, 14; 400/76, 61, 70

(56) References Cited

U.S. PATENT DOCUMENTS

| | | | | |
|---|---|---|---|---|
| 5,984,446 | A | 11/1999 | Silverbrook | 347/3 |
| 6,145,980 | A | 11/2000 | Wang | 347/104 |
| 6,244,699 | B1 | 6/2001 | Brugue et al. | 347/101 |
| 6,375,296 | B1 | 4/2002 | McGarry et al. | |
| 2001/0033050 | A1 | 10/2001 | Kinoshita et al. | |

FOREIGN PATENT DOCUMENTS

| | | |
|---|---|---|
| EP | 0730246 | 9/1996 |
| GB | 2352211 | 1/2001 |

OTHER PUBLICATIONS

British Search Report dated Oct. 17, 2002.

*Primary Examiner*—Judy Nguyen
*Assistant Examiner*—Lam S Nguyen

(57) ABSTRACT

A method of and printing system for printing a multiple page print job on a print medium. A shingling sequence for a first page of the multiple page print job is opened by successively passing a printhead over the print medium and the first page is printed in a steady state mode of the printhead. The steady state mode of the printhead is maintained during a transition between printing the first page and printing a second page of the multiple page print job, such that the second page is printed as a continuation of the shingling sequence for the first page.

22 Claims, 3 Drawing Sheets

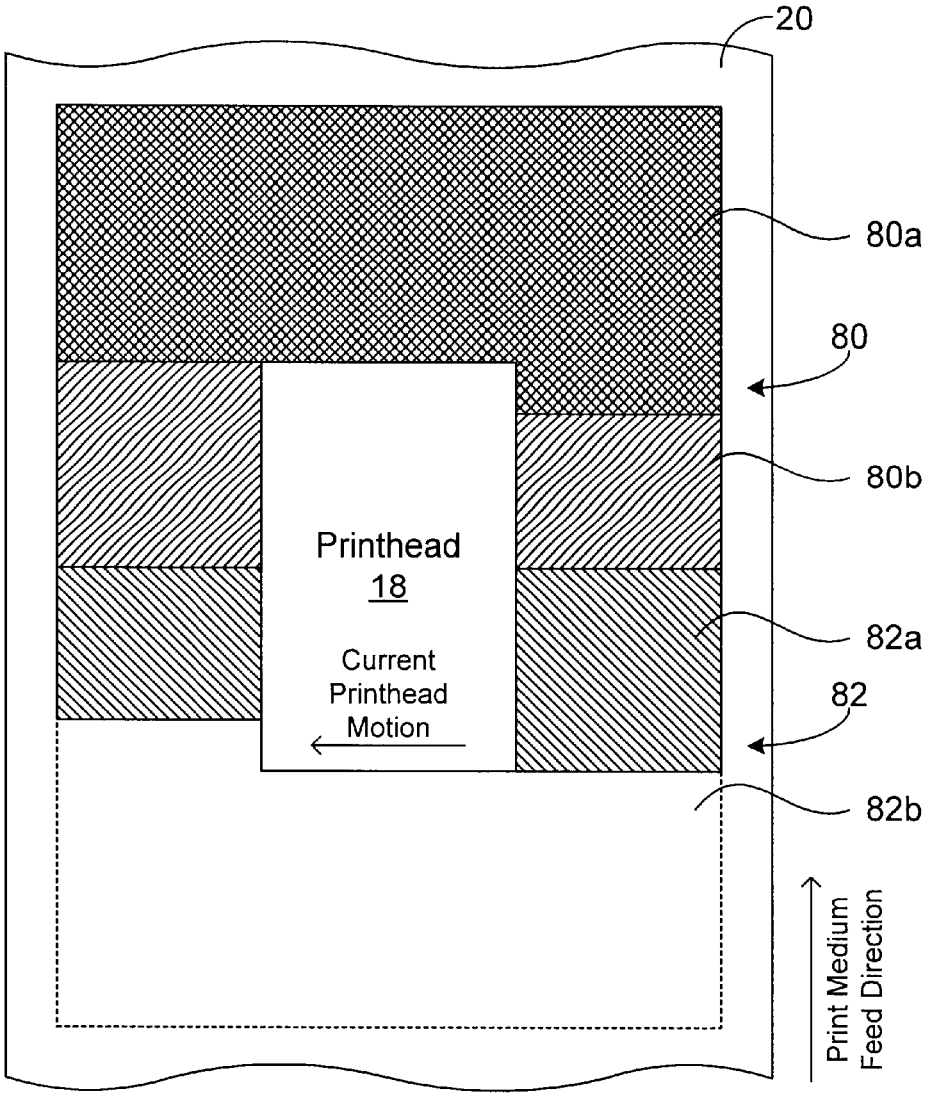
FIG. 4
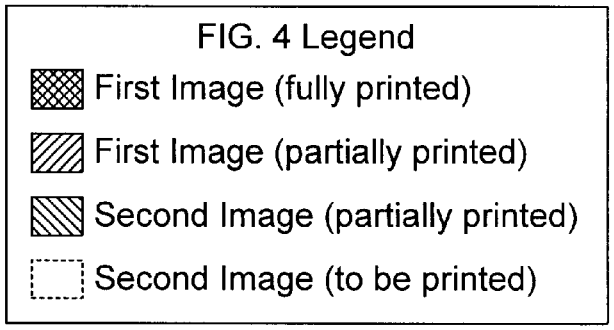

PRINTING SYSTEM AND METHOD USING PAGE STITCHING FOR PRINTING ON ROLL MEDIA

TECHNICAL FIELD

The present invention generally relates to printers and, more particularly, to printing on roll media using a page stitching technique.

BACKGROUND OF THE INVENTION

Inkjet printers are often used to print documents and images on a print medium. The print medium can include sheet media and roll media. Sheet and roll media can be formed from a variety of stock types, such as paper, photograph print media and the like.

A conventional inkjet printer includes a movable inkjet printhead mounted on a carriage assembly. The carriage assembly moves the inkjet printhead laterally over the print medium in successive passes. The print medium is advanced in a direction perpendicular to the motion of the printhead by a drive assembly so that the printhead can progressively lay down segments of the desired pattern being printed.

The printhead has an array of nozzles. Each nozzle generates ink droplets as the printhead moves over the print medium to produce the desired pattern on the print medium. Typically, each nozzle is formed by a nozzle chamber, a firing mechanism, and an orifice, with the firing mechanism being located within the nozzle chamber. Each nozzle is supplied with ink from an ink supply reservoir, noting that different nozzles can be supplied with ink from different ink reservoirs for printing multiple colors or for printing on different types of media.

A trend in printer technology has been to increase the speed with which a multiple page document and/or multiple images can be printed. One solution has been to use roll media instead of sheet media so that the printer does not spend time loading and ejecting the print media. The roll media is then cut by a cutting assembly between document pages or images.

For some applications, greater speed is still desired. As an example, the prolific use of digital cameras has created a need for printing photographs on photographic print media. Commercial enterprises would like to service customers who desire a printout of a series of photographs as quickly as possible.

Accordingly, there exists a need in the art to increase the speed with which successive pages and/or images can be printed on a print media.

SUMMARY OF THE INVENTION

According to one aspect of the invention, the invention is a method of printing a multiple page print job on a print medium is provided. The method includes opening a shingling sequence for a first page of the multiple page print job by successively passing a printhead over the print medium and printing the first page in a steady state mode of the printhead; and maintaining the steady state mode of the printhead during a transition between printing the first page and printing a second page of the multiple page print job, such that the second page is printed as a continuation of the shingling sequence for the first page.

According to another aspect of the invention, the invention is a method of printing a multiple page print job on a print medium. The method includes receiving the multiple page print job from a print job source with a controller; transmitting print data for a first page of the multiple page print job from the controller to a print engine; controlling a printhead with signals from the print engine to print the first page with successive passes of the printhead over the print medium; transmitting a stitch next page command from the controller to the print engine; and further controlling the printhead with signals from the print engine to print a second page of the multiple page print job with successive passes of the printhead as a continuation of the first page.

According to yet anther aspect of the invention, the invention is a printer system. The printer system includes a printhead for printing on a print medium during successive passes over the print medium; and a control assembly for controlling the printhead to print a multiple page print job by opening a shingling sequence for a first page of the multiple page print job and printing the first page in a steady state mode of the printhead and maintaining the steady state mode of the printhead during a transition between printing the first page and printing a second page of the multiple page print job such that the second page is printed as a continuation of the shingling sequence for the first page.

According to still another aspect of the invention, the invention is a printer system. The printer system including a printhead for printing on a print medium during successive passes over the print medium; a controller for receiving a multiple page print job from a print job source; and a print engine for controlling the printhead in accordance with print data received from the controller corresponding to the multiple page print job, the print engine controlling the printhead to print a first page of the multiple page print job and to print a second page of the multiple page print job as a continuation of the first page in response to a stitch next page command received from the controller.

BRIEF DESCRIPTION OF THE SEVERAL VIEWS OF THE DRAWINGS

These and further features of the present invention will be apparent with reference to the following description and drawings. To illustrate the present invention in a clear and concise manner, the drawings may not necessarily be to scale and certain features may be shown in somewhat schematic form.

FIG. 4 is an exemplary multiple page print job being printed by the printer system of FIG. 1.

DETAILED DESCRIPTION OF THE INVENTION

Figure 1:
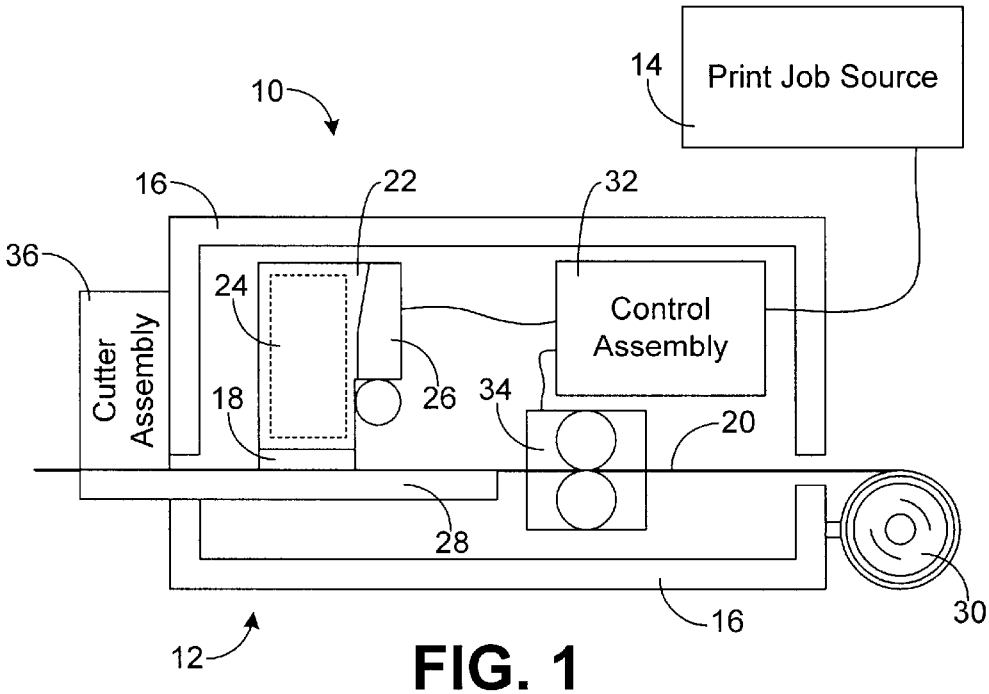
FIG. 1 is a block diagram of a printer system according to the present invention.

In the detailed description that follows, identical components have been given the same reference numerals, regardless of whether they are shown in different embodiments of the present invention.

Referring initially to FIG. 1, a printer system 10 is illustrated. The illustrated printer system 10 includes an inkjet printer 12 coupled to receive a print job from a print job source 14. The print job can be in a format compatible with the printer, such as a page description language (PDL) file or a page control language (PCL) file.

As one skilled in the art will appreciate, the illustrated inkjet printer 12 is exemplary and the present invention applies to inkjet printers having different configurations and other types of printers that print by making successive passes over a print medium such as, for example, a thermal printer, a plotter, etc.

The print job source 14 can be, for example, a computer, a personal digital assistant (PDA), a network server, or the like. The printer 12 can be connected directly to the print job source 14 or coupled to the print job source 14 via a network. Alternatively, the print job source 14 can be a dedicated device such as, for example, a camera or an electronic photograph processing machine.

The printer 12 includes a housing 16 that supports the various subcomponents of the printer 12 described below. The printer 12 includes an inkjet printhead 18 used to print a desired pattern as dictated by the print job on a print medium 20 by printing on, or imaging, the print medium. For this purpose, the printhead 18 can be mounted on a print cartridge 22 having one or more ink supply reservoirs 24. The print cartridge 22 can be removably supported by a print cartridge carriage 26 that moves the printhead 18 laterally over the print medium 20 as is known in the art. A platen 28, having a paper supporting surface, is disposed under the print medium 20 opposite the printhead 18. As one skilled in the art will appreciate, other types of printheads, pens, nozzle assemblies, heater elements and the like can be used in place of the printhead 18 and generally depends on the specific printer.

The print medium 20 is supplied from a roll of stock material 30 that forms a continuous web of printable material. The printable material can be, for example, paper, photographic print media, or the like.

Movement of the printhead 18 and deposition of ink from the printhead 18 onto the print medium 20 is controlled by a control assembly 32. The control assembly 32 also controls a drive assembly 34 for advancing the print medium 20 through the printer 12. A cutter assembly 36, also under the control of the control assembly 32, is provided to cut the web of material comprising the print medium 20 between printed pages or images such that individual printed sheets are produced by the printer 12. As one skilled in the art will appreciate, the printer 12 can be provided with additional subassemblies for assisting in printing on the print medium 20 and can include, for example, rollers, mechanical actuators, power supplies, a communications interface for communicating with the print job source 14, etc.

Figure 2:
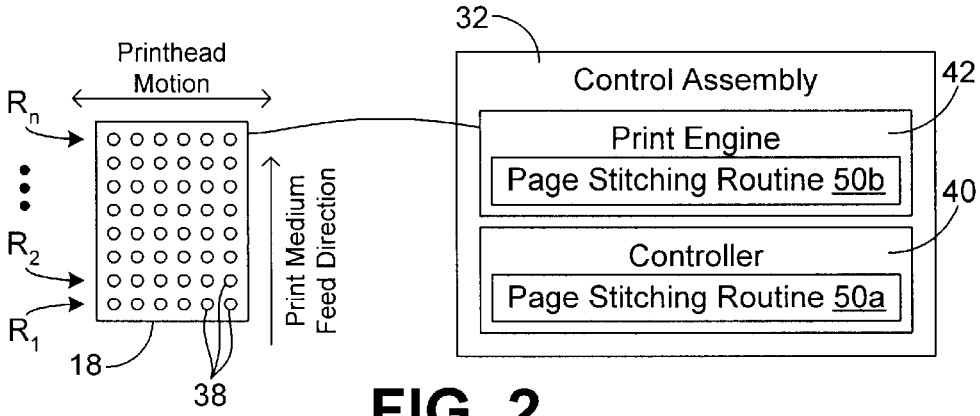
FIG. 2 is a block diagram of a printhead and a printer control assembly of the printer system of FIG. 1.

With additional reference to FIG. 2, a block diagram of the printhead 18 and the control assembly 32 is illustrated. More specifically, FIG. 2 illustrates the underside of the printhead 18 that is disposed adjacent the print medium 20 (FIG. 1) for depositing ink thereon. The printhead 18 has an array of nozzles 38. Each nozzle 38 generates ink droplets as the printhead 18 moves over the print medium 20 to produce a desired image on the print medium 20. Each nozzle 38 can be formed from a nozzle chamber, a firing mechanism and an orifice, with the firing mechanism being located within the nozzle chamber.

The printhead 18 is moved laterally over the print medium in successive passes. In addition, the print medium 20 is advanced, usually between passes of the printhead 18, in a direction perpendicular to the motion of the printhead 18 so that the printhead 18 progressively lays down segments (or portions) of the desired pattern being printed. Each segment of the desired pattern can potentially overlap with adjacent segments of the desired pattern depending on the arrangement of printhead sections as discussed below.

As used herein, the terms page and image are used interchangeably and in their broadest sense to define that which is normally printed on a single sheet of material and can include, for example, a sheet of text and/or graphics, an image, a drawing, a photograph, and the like.

In the illustrated embodiment, the printhead 18 has eight sections (or groups) of nozzles 38, identified generically as section $R_1$ to section $R_n$. In an N-pass printmode (i.e., the printhead passes over the same portion of the print media N times), the printhead (or at least an active portion thereof) is divided into N sections. Each section contains one or more rows of nozzles. The number of rows per section can be determined by dividing the total number of rows by the number of sections (provided that the rows are evenly dedicated among the sections). For example, if the printhead has 512 rows of nozzles and is engaged in an eight-pass printmode, the printhead will have eight sections and each section will have 64 rows of nozzles (512 rows/eight sections=64 rows per section). Multiple nozzles 18 arranged in rows are used to provide for multiple passes of the printhead 18 over the same place on the print medium for at least two reasons including, hiding defects created by missing or defective nozzles 38 and to lay down multiple ink droplets of different color to achieve a desired color on the print medium 20 at any given position, or dot.

As one skilled in the art will appreciate, with each pass of the printhead 18, the pattern being printed is extended by segment of the image corresponding to a section of nozzles. More specifically, as the printhead 18 begins to print a pattern, the first section of nozzles 38, or section $R_1$, is used to place ink on the print medium 20. After the printhead 18 has made a full pass over the print medium 20, the print medium 20 is advanced and the printhead 18 is passed back over the print medium such that the second section of nozzles 38, or section $R_2$, prints over the segment of the pattern printed during the previous pass by the first section $R_1$. During the second pass, the first section $R_1$ prints onto an adjacent segment of the print medium. This process is continued until the print medium 20 is advanced to the last section of nozzles 38 such that each section of nozzles 38 is concurrently used to form the desired pattern on the print medium 20. As one skilled in the art will appreciate, if there are N sections of nozzles 38, at the beginning of printing the page it takes N−1 passes of the printhead 18 before the printhead 18 reaches steady state where each section of nozzles 38 is used to form the desired pattern on the print medium 20 (whether or not each nozzle, each row of nozzles or each section of nozzles is actively expressing ink). Traditionally, when the printer 12 nears the end of printing a page, the forgoing process is reversed to close out the print operation of the page being printed. More specifically, N−1 sections of nozzles 38 are used to print on the print medium 20 then, with the next pass, N−2 sections of nozzles 38 are used to print on the print medium 20 and so forth until the last segment of the pattern is printed with the last section $R_n$ of nozzles 38. Therefore, the ending phase of printing a page takes N−1 passes to close out the printing sequence from steady state.

The foregoing operation of the printer 12 defines a shingling sequence that includes a starting phase (bringing the printhead 18 up to a steady state phase), a steady state phase, and an ending phase (or "closing out" from steady state). For a print mode having N number of passes of the printhead 18 over each segment of the print media 20, the starting phase takes N−1 passes to reach the steady state phase. Similarly, the ending phase takes N−1 passes to close out the shingling sequence from steady state. As will be described in greater detail below, the present invention avoids closing out between printed pages. Therefore, the operation of the printer 12 saves N−1 passes for each transition between printed pages by remaining in the steady state phase of the shingling sequence. This is accomplished by a page stitching routine where two or more pages are combined together into one virtual page.

With continued reference to FIG. 2, the control assembly includes a controller 40 that communicates with the print job source 14 to receive a print job. The controller 40 converts, or renders, the print job into a format for printing by the printhead 18 such as, for example, a raster image. The controller 40 then selectively transmits portions of the converted, or rendered, print job to a print engine 42 along with associated commands and control signals for the print engine 42. The print engine 42, in turn, controls the firing of the nozzles 38 to lay down the desired pattern on the print medium 20.

The controller 40 and the print engine 42 are each provided with appropriate page stitching routine 50 segments (50*a* and 50*b*) in the form of logic, code, firmware, circuitry or the like. In the page stitching technique of the present invention, the print engine 42 is instructed by the controller 40 to attempt to stitch pages of a multiple page print job together. The controller 40 generates and sends pages of print data to the print engine 42 as normal pages. As a result, the page stitching operation is transparent to the controller 40, with the exception of transmitting a stitch page command to the print engine 42. As a result of the page stitching operation, the printing of multiple pages can be accomplished without closing out each page (i.e., entering the ending phase of the shingling sequence normally used for printing a page) or stopping operation of the printhead 18 between pages. It is noted that momentary pausing of printhead motion 18 and/or print medium 20 advancement may be made during operation of the cutter assembly 36 so that the cutter assembly 36 can cut the web of material 30 between printed pages.

Figure 3:
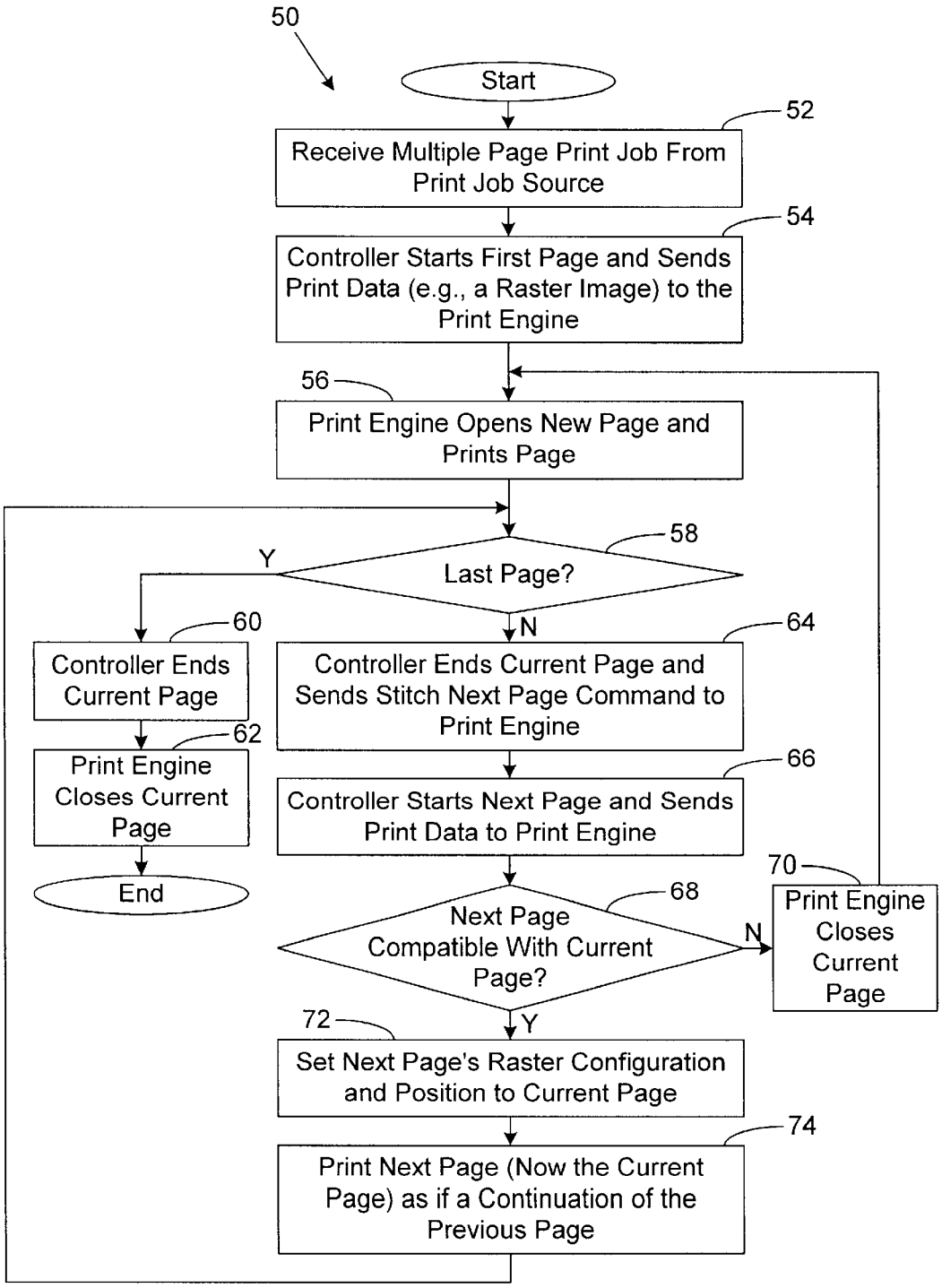
FIG. 3 is a flowchart of a page stitching operation of the printer system of FIG. 1.

With additional reference to FIG. 3, shown is a flowchart of the page stitching routine 50 of the printer 12 according to an embodiment of the present invention. Alternatively, the flowchart of FIG. 3 can be viewed as depicting steps of a method implemented in the printer 12. Logic to carry out the page stitching routine 50 can be embodied in software or code executed by a processor portion or portions of the control assembly 32, embodied in firmware programmed into the controller 40 and/or the print engine 42, embodied in dedicated hardware or a combination thereof. As one skilled in the art will appreciate, the flow chart of FIG. 3 is exemplary and alternative descriptions and illustrations of the page stitching routine 50 falling within the scope of the claims appended hereto can be made.

The page stitching routine 50 starts in box 52 where the printer 12, and more specifically the controller 32, receives a multiple page print job from the print job source 14. The controller 40 then starts processing of the first page from the multiple page print job in box 54. Also in box 54, the controller sends print data acceptable to the print engine 42 (such as, for example, a raster image) for the first page to the print engine.

Thereafter, in box 56, the print engine 42 opens a new page and prints the page by sending appropriate command signals to the printhead 18. The opening of the page involves starting a shingling sequence and bringing the printhead 18 to steady state as described above.

In box 58, the controller 40 determines whether the currently serviced page is the last page of the multiple page print job. If the current page is the last page of the print job, the page stitching routine 50 proceeds to box 60 where the controller 40 ends processing of the current page and, in box 62, the print engine 42 finishes printing the current page by closing out the shingling sequence.

If, in box 58, the page currently being serviced is not the last page of the multiple print job, the page stitching routine 50 proceeds to box 64. In box 64, the controller 40 ends its processing of the current page and send a signal, or command, to the print engine 42 instructing the print engine 42 to stitch the next page to the page currently being printed. The stitch next page command instructs the print engine 42 to continue printing the next page as if it were a continuation of the page currently being printed without bringing the printhead 18 out of steady state operation. It is noted that under certain circumstances, it may be difficult to stitch the next page to the current page. These situations are described below.

Next, in box 66, the controller 40 starts processing the next page and sends print data for the next page to the print engine 42. Thereafter, in box 68, the print engine 42 determines whether the next page is compatible with the page currently being printed in box 68. More specifically, the print engine 42 determines whether the next page can be stitched to the page currently being printed or if the print engine 42 should perform a closing out operation to end the shingling sequence for the page currently being printed and start a new shingling sequence for the next page.

To determine whether the pages are compatible for page stitching, the print engine 42 compares the servicing requirements of the two pages. Servicing requirements include, for example, page width, left margin position, right margin position, and the like. If the print engine 42 determines that the pages are not compatible in box 68, the page stitching routine 50 proceeds to box 70 where the print engine 42 closes the current page by ending the shingling sequence for the current page. Thereafter, the page stitching routine 50 returns to box 56 where the print engine 42 prints the next page by beginning a new shingling sequence.

If, in box 68, the next page is compatible with the page currently being printed, the page stitching routine 50 proceeds to box 72 where the print engine 42 sets the next page's raster configuration and position (e.g., layout parameters such as left and right margin positions) to the raster configuration and position of the page currently being printed. Next, in box 74, the print engine 42 controls the printhead 18 to print the next page (now considered the current page) as if this page were a continuation of the previous page. The page stitching routine 50 then returns to box 58 to continue processing of the multiple page print job.

The foregoing page stitching routine 50 allows the print engine 42 to improve printing performance when printing on a continuous strip of print media (e.g., a roll of print media) by avoiding the closing out of a shingling sequence between pages. The page stitching routine described herein for a print mode with N passes of the printhead saves N−1 passes between each page when no space is printed between successive pages. As explained below, a lower number of passes will be saved between page transitions when blank space is desired between pages. For a multi-page document of P pages, there are P−1 page transitions. Therefore, a total possible time savings can be calculated by solving the equation $(P-1)\times(N-1)\times T$, where T is the time that it takes the printhead 18 to complete a pass. For example, when processing a 10 page print job using a 8 pass print mode where each pass takes 0.5 seconds to complete, the possible time savings is $(10-1)\times(8-1)\times 0.5$, or 31.5 seconds.

With additional reference to FIG. 4, a first page 80 and a second page 82 of a multiple page print job in the process of being printed is illustrated. As illustrated, a first portion 80*a* of the first page 80 has been fully printed by the deposition of ink by the printhead 18 during successive passes of the printhead 18. A second portion 80*b* of the first page 80 is currently being printed and will become fully printed after each of section of nozzles 38 of the printhead 18 completes a pass over each segment of the second portion 80*b*. A first portion 82*a* of the second page 82 has been partially printed by the first few sections of nozzles 38 of the printhead 18. As the printing continues by passes of the printhead 18 and advancement of the print medium 20, the second page 82 (including a second portion 82*b* not yet exposed to the printhead 18), and any subsequent pages, will become fully printed.

As indicated, the page stitching technique of the present invention results in maximum efficiency when the last segment of a page is printed adjacent the first segment of the next page without space therebetween. However, an increase in performance can still be achieved even when a space between pages on the print medium 20 is desired. During page stitching, when the first section $R_1$ of the printhead 18 passes over the last segment of a page currently being printed, the first segment of the next page will be printed with the first section $R_1$ of the printhead 18 on the next pass of the printhead 18. If blank, or unprinted, space is desired between pages, the printhead 18 will continue to make passes over the print medium 20 but one or more sections of nozzles 38 will not express ink onto the print medium 20. For example, if the printhead has eight sections of nozzles 38 and each section is responsible for printing an eighth of an inch and a quarter inch space is desired between pages, then after the first section $R_1$ prints the last segment of the leading page the first section $R_1$ on the next pass of the printhead will not print during the next pass of the printhead 18. On the subsequent pass of the printhead 18, the first section $R_1$ and the second section $R_2$ will not print. On the following pass of the printhead 18, the third section $R_3$ and the second section $R_2$ will not print, but the first section $R_1$ commences printing of the first segment of the following page. As one skilled in the art should appreciate from the forgoing example, for each unprinted length of print medium 20 equaling the amount of print medium 20 normally printed by a section of the printhead 18, two additional passes of the printhead 18 will be made that would otherwise not be made when the pages are printed without a space therebetween. In the forgoing example, the space between the pages is twice the space normally printed by a section of the printhead 18 and four additional passes of the printhead 18 would be made to create the blank space compared to a situation where the pages were printed without a space therebetween.

Although the logic used to carry out the page stitching routine 50 of the present invention in the illustrated embodiment can be embodied in programmed hardware components of the controller 40 and the print engine 42, the logic can be embodied in software or code executed by a general purpose processor or can be embodied in dedicated hardware or a combination of software and hardware. If embodied in dedicated hardware, the logic can be implemented as a circuit or a state machine that employs any one of or a combination of a number of techniques. These technologies may include, but are not limited to, discrete logic circuits having logic gates for implementing various logic functions upon an application of one or more data signals, application specific integrated circuits having appropriate logic states, programmable gate arrays (PGA), field programmable gate arrays (FPGA), or other components. Such technologies are generally well known by those skilled in the art and, consequently, are not described in detail herein.

The figures show the architecture, functionality and operation of an implementation of the page stitching routine 50. If embodied in software, each illustrated block may represent a module, segment or portion of code that comprises program instructions to implement the specific logical function(s). The program instructions may be embodied in a form of source code that comprises human readable statement written in a programming language or machine code that comprises numerical instructions recognizable by a suitable execution system such as a processor. The machine code may be converted from the source code. If embodied in hardware, each block may represent a circuit or a number of interconnected circuits to implement the specified logical function(s).

Although the page stitching routine 50 illustrates a specific order of execution, it is understood that the order of execution may differ from that which is depicted. For example, the order of execution of two or more blocks may be changed relative to the order shown. Also, two or more blocks shown in succession may be executed concurrently or with partial concurrence. In addition, any number of counters, state variables, warning semaphores, or messages might be added to the logical flow described herein, for purposes of enhanced utility, accounting, performance measurement, or providing trouble shooting aids, and the like. It is understood that all such variations are within the scope of the present invention.

Also, where the page stitching routine 50 comprises software or code, the page stitching routine 50 can be embodied in any computer readable medium for use by or in connection with an instruction execution system such as, for example, a processor, or for subsequent "burning" into a programmable device. In this sense, the logic may comprise, for example, statements including instructions or declarations that can be fetched from the computer readable medium and executed by the instruction logic system. In the context of the present invention, a "computer readable medium" can be any medium that can contain, store or maintain the logic described herein for use by or in connection with the instruction execution system. A computer readable medium can comprise any one of any physical media such as, for example, electronic, magnetic, optical, electromagnetic, or semiconductor media. More specific examples of suitable computer readable medium include, but are not limited to, magnetic tapes, magnetic floppy diskettes, magnetic hard drives, or compact disks. Also, the computer readable medium can be random access memory (RAM). Alternatively, the computer readable medium can be read-only memory (ROM), a programmable read-only memory (PROM), an erasable, programmable read-only memory (EPROM), an electronically erasable, programmable, read-only memory (EEPROM), or other type of memory device.

Although particular embodiments of the invention have been described in detail, it is understood that the invention is not limited correspondingly in scope, but includes all changes, modifications and equivalents coming within the spirit and terms of the claims appended hereto.

What is claimed is:

1. A method of printing a multiple page print job on a print medium, comprising:

opening a shingling sequence for a first page of the multiple page print job by successively passing a printhead over the print medium and printing the first page in a steady state mode of the printhead;

maintaining the steady state mode of the printhead during a transition between printing the first page and printing a second page of the multiple page print job, such that the second page is printed as a continuation of the shingling sequence for the first page; and determining if the second page is compatible for printing as a continuation of the shingling sequence for the first page by comparing servicing requirements of the first page and the second page.

2. The method of claim 1, further comprising producing a blank space between the first page and the second page by controlling at least a portion of the printhead to not print on the print medium during selected passes over the print medium.

3. The method of claim 1, wherein the printhead is an inkjet printhead divided into a plurality of sections.

4. The method of claim 3, wherein the steady state mode includes producing a pattern on the print medium with each section of the printhead.

5. The method of claim 1, wherein the print medium is derived from a roll of stock material.

6. The method of claim 1, further comprising advancing the print medium between passes of the printhead.

7. A method of printing a multiple page print job on a print medium, comprising:

receiving the multiple page print job from a print job source with a controller;

transmitting print data for a first page of the multiple page print job from the controller to a print engine;

controlling a printhead with signals from the print engine to print the first page with successive passes of the printhead over the print medium;

transmitting a stitch next page command from the controller to the print engine;

further controlling the printhead with signals from the print engine to print a second page of the multiple page print job with successive passes of the printhead as a continuation of the first page; and determining if the second page is compatible for printing as a continuation of the shingling sequence for the first page by comparing servicing requirements of the first page and the second page.

8. The method of claim 7, further comprising producing a blank space between the first page and the second page by controlling at least a portion of the printhead to not print on the print medium during selected passes over the print medium.

9. The method of claim 7, wherein the printhead is an inkjet printhead divided into a plurality of sections.

10. The method of claim 7, wherein the print medium is derived from a roll of stock material.

11. The method of claim 7, further comprising advancing the print medium between passes of the printhead.

12. A printer system, comprising a printhead for printing on a print medium during successive passes over the print medium; and a control assembly for controlling the printhead to print a multiple page print job by opening a shingling sequence for a first page of the multiple page print job and printing the first page in a steady state mode of the printhead and maintaining the steady state mode of the printhead during a transition between printing the first page and printing a second page of the multiple page print job such that the second page is printed as a continuation of the shingling sequence for the first page; and wherein the control assembly determines if the second page is compatible for printing as a continuation of the shingling sequence for the first page by comparing servicing requirements of the first page and the second page.

13. The printer system of claim 12, wherein the control assembly is adapted to produce a blank space between the first page and the second page by controlling at least a portion of the printhead to not print on the print medium during selected passes over the print medium.

14. The printer system of claim 12, wherein the printhead is an inkjet printhead divided into a plurality of sections.

15. The printer system of claim 14, wherein the steady state mode includes producing a pattern on the print medium with each section of the printhead.

16. The printer system of claim 12, wherein the print medium is derived from a roll of stock material.

17. The printer system of claim 12, further comprising a drive assembly for advancing the print medium between passes of the printhead.

18. A printer system, comprising:

a printhead for printing on a print medium during successive passes over the print medium;

a controller for receiving a multiple page print job from a print job source; and a print engine for controlling the printhead in accordance with print data received from the controller corresponding to the multiple page print job, the print engine controlling the printhead to print a first page of the multiple page print job and to print a second page of the multiple page print job as a continuation of the first page in response to a stitch next page command received from the controller; and wherein the print engine determines if the second page is compatible for printing as a continuation of the shingling sequence for the first page by comparing servicing requirements of the first page and the second page.

19. The printer system of claim 18, wherein the printer system is adapted to produce a blank space between the first page and the second page by controlling at least a portion of the printhead to not print on the print medium during selected passes over the print medium.

20. The printer system of claim 18, wherein the printhead is an inkjet printhead divided into a plurality of sections.

21. The printer system of claim 18, wherein the print medium is derived from a roll of stock material.

22. The printer system of claim 18, further comprising a drive assembly for advancing the print medium between passes of the printhead.

* * * * *